US009325156B2

(12) United States Patent
Ban et al.

(10) Patent No.: US 9,325,156 B2
(45) Date of Patent: Apr. 26, 2016

(54) SPARK PLUG

(71) Applicant: NGK SPARK PLUG CO., LTD., Nagoya-shi, Aichi (JP)

(72) Inventors: Kenji Ban, Gifu (JP); Yoshikazu Kataoka, Nagoya (JP); Magoki Shimadate, Aichi (JP); Tomoaki Kato, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/590,075

(22) Filed: Jan. 6, 2015

(65) Prior Publication Data

US 2015/0207299 A1 Jul. 23, 2015

(30) Foreign Application Priority Data

Jan. 14, 2014 (JP) ..... 2014-004168

(51) Int. Cl.
*H01T 13/20* (2006.01)
*H01T 13/32* (2006.01)

(52) U.S. Cl.
CPC ..... *H01T 13/32* (2013.01); *H01T 13/20* (2013.01)

(58) Field of Classification Search
CPC ..... H01T 1/00; H01T 1/20; H01T 1/22; H01T 13/00; H01T 13/28; H01T 13/02; H01T 13/12; H01T 13/20
USPC ..... 313/118, 141, 142, 143, 144
See application file for complete search history.

(56) References Cited

U.S. PATENT DOCUMENTS

| | | | | |
|---|---|---|---|---|
| 5,877,584 | A * | 3/1999 | Kato et al. | 313/143 |
| 6,653,767 | B2 | 11/2003 | Morita et al. | 313/141 |
| 6,844,662 | B2 | 1/2005 | Morita et al. | 313/141 |
| 7,145,287 | B2 | 12/2006 | Kato | 313/141 |
| 7,282,844 | B2 | 10/2007 | Kanao et al. | 313/141 |
| 7,352,121 | B2 | 4/2008 | Ito et al. | 313/141 |
| 7,615,915 | B2 | 11/2009 | Ito et al. | 313/141 |
| 8,072,125 | B2 | 12/2011 | Torii et al. | 313/142 |
| 8,912,715 | B2 | 12/2014 | Ban | 313/141 |
| 2002/0038992 | A1 | 4/2002 | Morita et al. | 313/141 |

(Continued)

FOREIGN PATENT DOCUMENTS

| | | | |
|---|---|---|---|
| JP | 05159853 A | 6/1993 | H01T 13/20 |
| JP | 2002184551 A | 6/2002 | F02P 13/00 |

(Continued)

OTHER PUBLICATIONS

Office Action issued in corresponding Japanese Patent Application No. 2014-004168 dated Dec. 8, 2015 (English-language translation provided).

*Primary Examiner* — Nimeshkumar Patel
*Assistant Examiner* — Kevin Quarterman
(74) *Attorney, Agent, or Firm* — Kusner & Jaffe

(57) ABSTRACT

A spark plug wherein an outer diameter of a first face that is a gap foliating face of the center electrode tip is denoted as R1, an outer diameter of a second face that is a gap forming face of the ground electrode tip is denoted as R2, a length of the gap is denoted as G1, and an average distance of a distance between an end in the first direction of the first face and an end in the first direction of the second face and a distance between an end in the second direction of the first face and an end in the second direction of the second face is denoted as G2, R1<R2, 0.5 mm≤R1≤1.1 mm, 0.7 mm≤R2≤1.2 mm, 0.6 mm≤G1≤1.3 mm, and 1.4≤(R2/R1)×(G2/G1)≤1.8 are satisfied.

4 Claims, 4 Drawing Sheets

(56) References Cited

U.S. PATENT DOCUMENTS

| | | | | |
|---|---|---|---|---|
| 2004/0061421 | A1 | 4/2004 | Morita et al. | 313/142 |
| 2005/0057134 | A1 | 3/2005 | Kanao et al. | 313/141 |
| 2005/0067933 | A1* | 3/2005 | Kato | 313/141 |
| 2005/0093416 | A1 | 5/2005 | Ito et al. | 313/141 |
| 2006/0220512 | A1* | 10/2006 | Okabe et al. | 313/141 |
| 2007/0188065 | A1* | 8/2007 | Ishinada et al. | 313/141 |
| 2007/0216275 | A1* | 9/2007 | Torii et al. | 313/141 |
| 2007/0216278 | A1* | 9/2007 | Yoshida | 313/141 |
| 2007/0277764 | A1 | 12/2007 | Ito et al. | 123/169 |
| 2011/0193471 | A1* | 8/2011 | Kato | 313/141 |
| 2011/0210659 | A1* | 9/2011 | Suzuki et al. | 313/141 |
| 2012/0007488 | A1* | 1/2012 | Kameda et al. | 313/141 |
| 2013/0069516 | A1* | 3/2013 | Sumoyama et al. | 313/141 |
| 2013/0313962 | A1* | 11/2013 | Yoshimoto et al. | 313/141 |
| 2014/0239797 | A1 | 8/2014 | Ban | 313/141 |

FOREIGN PATENT DOCUMENTS

| | | | | |
|---|---|---|---|---|
| JP | 2005093220 | A | 4/2005 | H01T 13/20 |
| JP | 2007287667 | A | 11/2007 | H01T 13/32 |
| JP | 4227942 | B2 | 2/2009 | H01T 13/20 |
| JP | 4339219 | B2 | 10/2009 | H01T 13/20 |
| JP | 2013134824 | A | 7/2013 | H01T 13/20 |

* cited by examiner

SPARK PLUG

RELATED APPLICATIONS

This application claims the benefit of Japanese Patent Application No. 2014-004168, filed Jan. 14, 2014.

FIELD OF THE INVENTION

The present invention relates to a spark plug used for ignition in an internal combustion engine and the like.

BACKGROUND OF THE INVENTION

In a spark plug, a voltage is applied between a center electrode and a ground electrode that are insulated from each other by an insulator, and thereby a spark occurs at a gap formed between the front end part of the center electrode and the front end part of the ground electrode. As the ground electrode of the spark plug, there has been known a configuration in which a projection part projecting toward the center electrode from a ground electrode body is provided and the end part of the projection part forms the gap. Providing the projection part results in a longer distance between the gap and the ground electrode body. As a result, it is suppressed that the growth of a flame generated at the gap is restricted by the ground electrode body, so that ignitability of the spark plug can be improved. Further, the end part of the projection part is formed by using a noble metal, so that the wear resistance can be improved.

SUMMARY OF THE INVENTION

In recent years, however, due to a higher compression of an air-fuel mixture in the internal combustion engine, there has been an increased demand for the ignitability and/or the wear resistance of a spark plug. Therefore, further improvement of the ignitability and the wear resistance of the spark plug are desired.

An advantage of the present invention is improvement to the ignitability and the wear resistance of the spark plug.

The present invention has been made to solve at least a part of the above advantage and can be implemented as the following application examples.

APPLICATION EXAMPLE 1

In accordance with a first aspect of the present invention, there is provided a spark plug having:

a center electrode having a center electrode body extending along an axial direction and a center electrode tip joined to a front end of the center electrode body;

an insulator having an axial hole extending in the axial direction, wherein the center electrode is arranged in the axial hole;

a metal shell arranged around an outer circumference of the insulator; and a ground electrode including a ground electrode body electrically connected to the metal shell and a projection part that is a portion projecting toward the center electrode from an end part of the ground electrode body and includes a ground electrode tip forming a gap between itself and the center electrode tip, wherein, in a particular cross section including a center axis of the center electrode tip, when two directions that are orthogonal to a center axis of the center electrode tip and opposed to each other are denoted as a first direction and a second direction, an outer diameter of a first face that is a face of the center electrode tip forming the gap is denoted as R1, an outer diameter of a second face that is a face of the ground electrode tip forming the gap is denoted as R2, a length of the gap is denoted as G1, and an average distance of a distance between an end in the first direction of the first face and an end in the first direction of the second face and a distance between an end in the second direction of the first face and an end in the second direction of the second face is denoted as G2, $$R1<R2,$$

$$0.5\text{ mm}\leq R1\leq 1.1\text{ mm},$$

$$0.7\text{ mm}\leq R2\leq 1.2\text{ mm},$$

$$0.6\text{ mm}\leq G1\leq 1.3\text{ mm, and}$$

$$1.4\leq(R2/R1)\times(G2/G1)\leq 1.8$$

are satisfied.

A larger outer diameter R2 of the ground electrode tip with respect to the outer diameter R1 of the center electrode tip tends to result in the improvement of the wear resistance of the spark plug but also result in the degeneration of the ignitability of the spark plug. Further, a larger distance G2 between the edges of the electrodes with respect to the gap length G1 tends to result in the improvement of the wear resistance of the spark plug but also result in the degeneration of the ignitability of the spark plug. According to the above configuration, the optimization of the values of R1, R2, G1, and G2 allows for achieving both wear resistance and ignitability of the spark plug. Therefore, the ignitability and the wear resistance can be improved.

APPLICATION EXAMPLE 2

In accordance with a second aspect of the present invention, there is provided a spark plug according to the application example 1, wherein $(R2/R1)\times(G2/G1)\leq 1.69$ is satisfied.

According to the above configuration, the further optimization of the values of R1, R2, G1, and G2 allows for further improvement of the wear resistance of the spark plug.

APPLICATION EXAMPLE 3

In accordance with a third aspect of the present invention, there is provided a spark plug according to the application example 2, wherein, when a length to the second face from a surface of the ground electrode body on which the projection part is arranged is denoted as T, $0.7\text{ mm}\leq T\leq 1.1\text{ mm}$ is satisfied.

A larger length T from the surface of the ground electrode body to the second face that is a face forming the gap of the ground electrode tip tends to result in the improvement of the ignitability but also result in the degeneration of the wear resistance. According to the above configuration, the optimization of the value of T allows for further improvement of the wear resistance and the ignitability of the spark plug.

APPLICATION EXAMPLE 4

In accordance with a fourth aspect of the present invention, there is provided a spark plug according to any one of the application example 1 to the application example 3, wherein the ground electrode body is a bar-shaped member including a base material that is a portion forming at least a part of a surface of the ground electrode body and a core part buried in the base material and having a higher thermal conductivity than the base material, and wherein, when a length in a longitudinal direction of a portion including the core part of the ground electrode body along a shape of the ground electrode body is denoted as L and a length in the axial direction from a front end of the metal shell to a front end of the ground electrode is denoted as C, $0.98 \leq (L/C) \leq 1.48$ is satisfied.

A longer length L of the core part with respect to the length C in the axial direction from the front end of the metal shell to the front end of the ground electrode allows for the improvement of the heat conductivity performance of the ground electrode. A higher heat conductivity performance of the ground electrode allows for the suppression of the occurrence of the pre-ignition due to the ground electrode. On the other hand, a higher heat conductivity performance causes the degeneration of the anti-peeling performance. According to the above configuration, the optimization of (L/C) that is the ratio of the length L to the length C allows for achieving both suppression of the occurrence of the pre-ignition due to the ground electrode and improvement of the anti-peeling performance.

It is noted that the present invention can be implemented in various forms, for example, can be implemented in the forms of a spark plug and an ignition apparatus with a use of the spark plug, an internal combustion engine in which the spark plug is mounted, an internal combustion engine in which the ignition apparatus with the use of the spark plug is mounted, and so on.

DETAILED DESCRIPTION OF THE PREFERRED EMBODIMENTS

A. Embodiments

Figure 1:
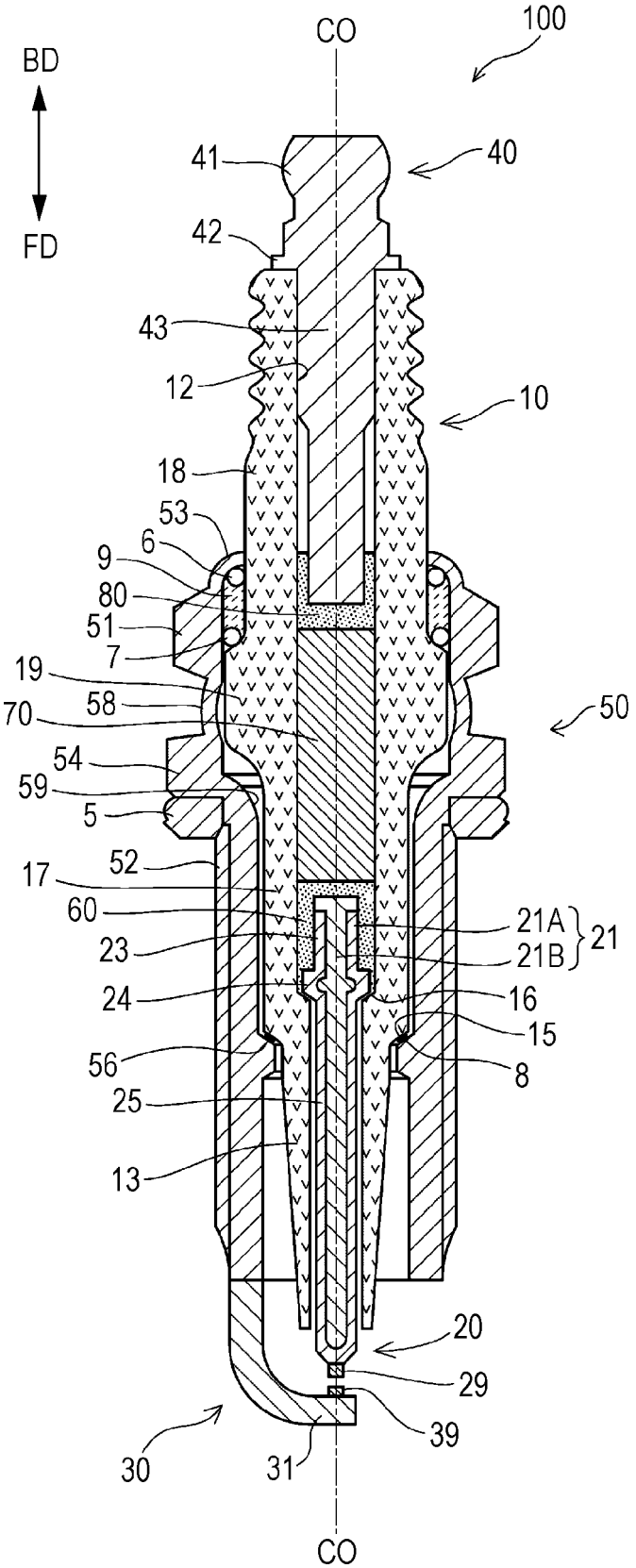
FIG. 1 is a sectional view of a spark plug 100 of the present embodiment.

A-1. Configuration of the Spark Plug:

Embodiments of the present invention will be described below based on the drawings. FIG. 1 is a sectional view of a spark plug 100 of the present embodiment. The dot-dash line of FIG. 1 represents an axial line CO of the spark plug 100 (also referred to as axial line CO). The direction parallel to the axial line CO (the vertical direction in FIG. 1) is also referred to as axial direction. The radial direction of a circle centered at the axial line CO is also referred to as simply "radial direction", and the circumferential direction of the circle centered at the axial line CO is also referred to as simply "circumferential direction". The downward direction in FIG. 1 is referred to as front end direction FD and the upward direction is referred to as rear end direction BD. The lower side in FIG. 1 is referred to as front end side in the spark plug 100 and the upper side in FIG. 1 is referred to as rear end side in the spark plug 100. The spark plug 100 has an insulator 10 as an insulator, a center electrode 20, a ground electrode 30, a terminal metal fitting 40, and a metal shell 50.

The insulator 10 is formed by sintering alumina and the like. The insulator 10 is substantially a cylindrical member extending along the axial direction and having a through-hole 12 (an axial hole) penetrating the insulator 10. The insulator 10 has a flange part 19, a rear-end-side trunk part 18, a front-end-side trunk part 17, a step part 15, and a nose part 13. The rear-end-side trunk part 18 is located in the rear end side of the flange part 19 and has a smaller diameter than the outer diameter of the flange part 19. The front-end-side trunk part 17 is located in the front end side of the flange part 19 and has a smaller diameter than the outer diameter of the flange part 19. The nose part 13 is located in the front end side of the front-end-side trunk part 17 and has a smaller diameter than the outer diameter of the front-end-side trunk part 17. When the spark plug 100 is mounted in the internal combustion engine (not shown), the nose part 13 is exposed in a combustion chamber of the internal combustion engine. The step part 15 is formed between the nose part 13 and the front-end-side trunk part 17.

The metal shell 50 is a cylindrical metal shell formed of a conductive metal material (for example, a low-carbon steel material) adapted to fix the spark plug 100 to an engine head (depiction is omitted) of the internal combustion engine. In the metal shell 50, an insertion hole 59 penetrating it along the axial line CO is formed. The metal shell 50 is arranged around the outer circumference of the insulator 10. That is, the insulator 10 is inserted and held inside the insertion hole 59 of the metal shell 50. The front end of the insulator 10 protrudes to the front end side with respect to the front end of the metal shell 50. The rear end of the insulator 10 protrudes to the rear end side with respect to the rear end of the metal shell 50.

The metal shell 50 has a hexagonal-cylindrical tool engagement part 51 to which a spark plug wrench is engaged, a mounting screw part 52 for installation to the internal combustion engine, and a flange-like seat part 54 formed between the tool engagement part 51 and the mounting screw part 52. The nominal diameter of the mounting screw part 52 is any one of M8 (8 mm (millimeter)), M10, M12, M14, and M18, for example.

An annular gasket 5 that is formed by bending a metal sheet is inserted and fitted between the mounting screw part 52 and the seat part 54 of the metal shell 50. The gasket 5 seals the clearance between the spark plug 100 and the internal combustion engine (the engine head) when the spark plug 100 has been installed to the internal combustion engine.

The metal shell 50 further has a thin crimp part 53 provided to the rear end side in the tool engagement part 51, and a thin compressively deformed part 58 provided between the seat part 54 and the tool engagement part 51. Annular ring members 6 and 7 are arranged in the annular area formed between the inner circumference surface of the portion from the tool engagement part 51 up to the crimp part 53 of the metal shell 50 and the outer circumference surface of the rear-end-side trunk part 18 of the insulator 10. Powder of talc (talcum) 9 is filled between the two ring members 6 and 7 in that area. The rear end of the crimp part 53 is bent inward in the radial direction and fixed to the outer circumference surface of the insulator 10. The compressively deformed part 58 of the metal shell 50 is compressed and deformed at the manufacturing by that the crimp part 53 fixed to the outer circumference surface of the insulator 10 is pressed toward the front end side. The compression deformation of the compressively deformed part 58 causes the insulator 10 to be pressed toward the front end side within the metal shell 50 via the ring members 6 and 7 and the talc 9. The step part 15 of the insulator 10 (an insulator-side step part) is pressed by a step part 56 formed on the inner circumference of the mounting screw part 52 of the metal shell 50 (a metal shell-side step part) via a metallic annular plate packing 8. As a result, the plate packing 8 prevents the gas inside the combustion chamber of the internal combustion engine from being leaked out from the clearance between the metal shell 50 and the insulator 10.

The center electrode 20 has a bar-shaped center electrode body 21 extending along the axial direction and a column-shaped center electrode tip 29 joined to the front end of the center electrode body 21. The center electrode body 21 is arranged at a portion in the front end side inside the through-hole 12 of the insulator 10. The center electrode body 21 has structure including an electrode base material 21A and a core part 21B buried inside the electrode base material 21A. The electrode base material 21A is formed of, for example, nickel or an alloy whose main component is nickel, which is the Inconel™ 600 in the present embodiment. The core part 21B is formed of copper or an alloy whose main component is copper that is superior in the thermal conductivity to the alloy forming the electrode base material 21A, which is copper in the present embodiment.

Further, the center electrode body 21 has a flange part 24 (also referred to as flange part) provided at a predetermined position in the axial direction, a head part 23 (an electrode head part) that is a portion in the rear end side of the flange part 24, and a nose part 25 (an electrode nose part) that is a portion in the front end side of the flange part 24. The flange part 24 is supported by a step part 16 of the insulator 10. The front end portion of the nose part 25, that is, the front end of the center electrode body 21 projects in the front end side with respect to the front end of the insulator 10.

The ground electrode 30 has a ground electrode body 31 joined to the front end of the metal shell 50 and a column-shaped ground electrode tip 39.

The terminal metal fitting 40 is a bar-like member extending in the axial direction. The terminal metal fitting 40 is formed of a conductive metal material (for example, a low-carbon steel) and, on the surface of the terminal metal fitting 40, a metallic layer (for example, an Ni layer) for anti-corrosion is formed by plating or the like. The terminal metal fitting 40 has a flange part 42 (a terminal flange part) formed at a predetermined position in the axial direction, a cap mounting part 41 located in the rear end side of the flange part 42, and a nose part 43 (a terminal nose part) in the front end side of the flange part 42. The cap mounting part 41 of the terminal metal fitting 40 is exposed in the rear end side of the insulator 10. The nose part 43 of the terminal metal fitting 40 is inserted in the through-hole 12 of the insulator 10. To the cap mounting part 41, a plug cap connected with a high-voltage cable (out of the figure) is mounted and a high voltage for generating a spark is applied.

Inside the through-hole 12 of the insulator 10, a resistor 70 for reducing the radio interference noise at the occurrence of the spark is arranged between the front end of the terminal metal fitting 40 (the front end of the nose part 43) and the rear end of the center electrode 20 (the rear end of the head part 23). The resistor 70 is formed of a composition containing glass particles as the main component, ceramic particles other than the glass, and a conductive material. Inside the through-hole 12, the clearance between the resistor 70 and the center electrode 20 is filled with a conductive seal 60. The clearance between the resistor 70 and the terminal metal fitting 40 is filled with a conductive seal 80. The conductive seals 60 and 80 are formed of a composition containing glass particles, such as $B_2O_3$—$SiO_2$ based glass, and metal particles (Cu, Fe, and the like).

Figure 2:
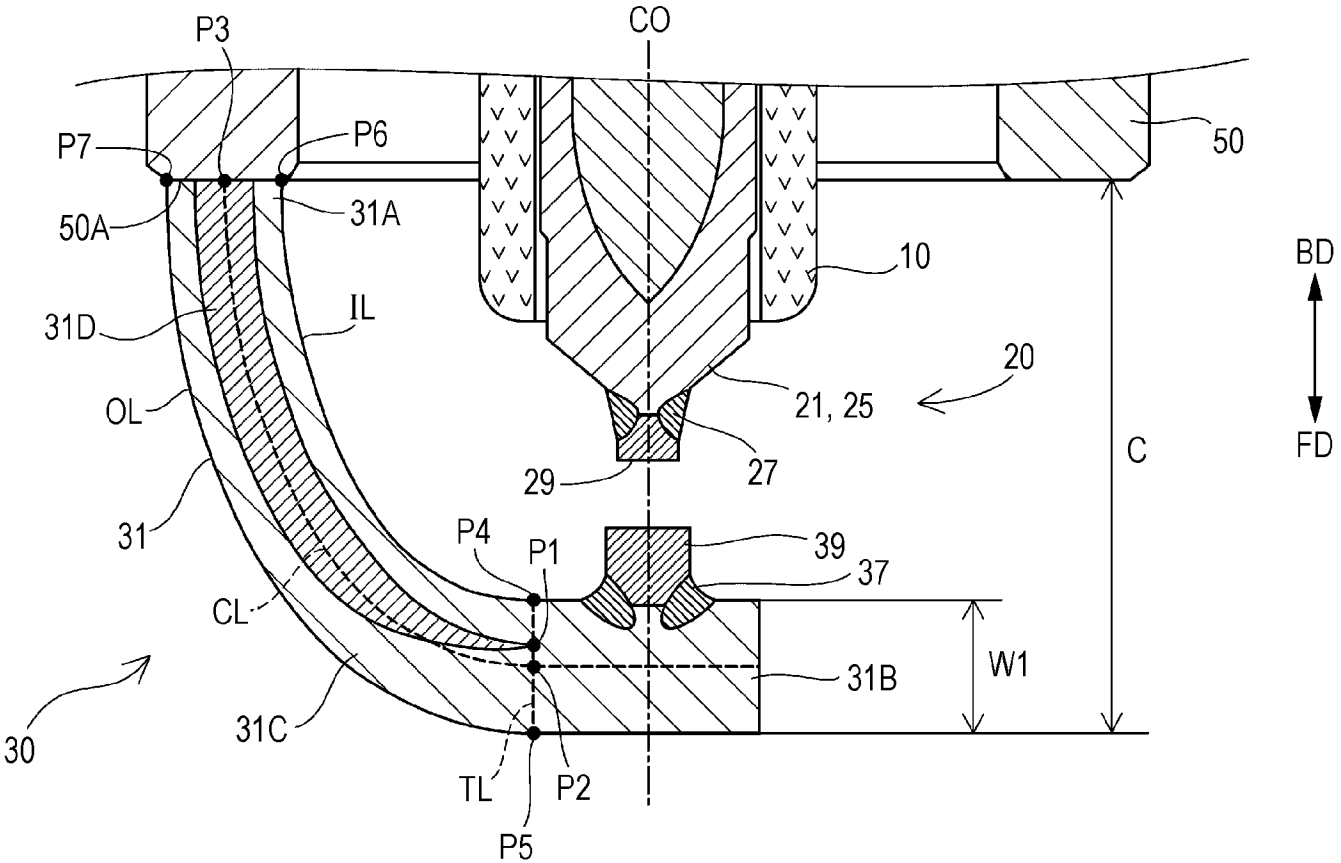
FIG. 2 is a sectional view in which a part around a front end of the spark plug 100 is cut by a plane including an axial line CO.

A-2. Configuration of the Front End Portion of the Spark Plug 100:

The configuration around the front end of the above-described spark plug 100 will be further described in detail. FIG. 2 is a sectional view in which the part around the front end of the spark plug 100 is cut by a plane including the axial line CO. In the spark plug 100 of the present embodiment, the center axis of the column-shaped center electrode tip 29 matches the axial line CO of the spark plug 100. Thus, it can be said that the cross section in FIG. 2 is a particular cross section including the center axis of the center electrode tip 29. The cross section in FIG. 2 further passes through the center in the circumferential direction of the rear end part of the ground electrode body 31. Therefore, the cross section in FIG. 2 includes the cross section of the ground electrode body 31.

The ground electrode body 31 is a curved bar-like member whose cross section is a rectangle. A rear end part 31A of the ground electrode body 31 is joined to a front end surface 50A of the metal shell 50. Thereby, the metal shell 50 and the ground electrode body 31 are electrically connected to each other. A front end part 31B of the ground electrode body 31 is a free end.

The ground electrode body 31 has structure including an electrode base material 31C and a core part 31D buried in the electrode base material 31C. The electrode base material 31C is formed of a metal having a high anti-corrosion, for example, a nickel alloy, which is the Inconel 601 in the present embodiment. The core part 31D is formed by using a metal having a higher thermal conductivity (a better thermal conductivity) than the electrode base material 31C, for example, copper or an alloy containing copper, which is copper in the present embodiment. It can be said that the electrode base material 31C is a portion forming the surface of the ground electrode body 31. A part of the core part 31D may be exposed in the surface of the ground electrode body 31, and the electrode base material 31C can be a portion forming at least a part of the surface of the ground electrode body 31.

In the cross section in FIG. 2, the length L of the portion including the core part 31D of the ground electrode body 31 is defined as follows. A position closest to the front end part 31B of the core part 31D is denoted as a point P1. In the surface of the ground electrode body 31, the line representing the face facing the center electrode 20 side is denoted as an inner side line IL and the line representing the face facing away from the center electrode 20 is denoted as an outer side line OL. The line connecting the points where the distance from the inner side line IL is equal to the distance from the outer side line OL is denoted as a center line CL of the ground electrode body 31. The intersection point of a line TL that passes through the point P1 and is orthogonal to the inner side line IL and the center line CL of the ground electrode body 31 is denoted as a point P2. The length along the center line CL is the length in the longitudinal direction along the shape of the ground electrode body 31. In the center line CL, the length of the portion from a rear end point P3 to the point P2 can be considered to be the length L of the portion including the core part 31D described above.

Here, the intersection point of the line TL of FIG. 2 and the inner side line IL is denoted as a point P4. Further, the intersection point of the line TL and the outer side line OL is denoted as a point P5. Further, in the inner side line IL, the length of the portion from a rear end point P6 to the point P4 is denoted as L1. Further, in the outer side line OL, the length of the portion from a rear end point P7 to the point P5 is denoted as L2. Here, the length L of the portion including the core part 31D described above, that is, the length of the portion from the rear end point P3 to the point P2 in the center line CL is substantially equal to the average value of the length L1 and the length L2. Thus, in the present specification, the length L of the portion including the core part 31D described above (hereafter, also referred to as core part length L) is defined as L=(L1+L2)/2.

Furthermore, the length in the axial direction from the front end of the metal shell 50 (the front end surface 50A) to the front end of the ground electrode 30 (the front end of the ground electrode body 31) is denoted as C (hereafter, also referred to as end part length C).

Further, the cross section of the ground electrode body 31 cut by a plane orthogonal to the center line CL is a rectangular. The length of the edge parallel to this cross section of FIG. 2 of the rectangular is denoted as W1. The length of the edge orthogonal to this cross section of FIG. 2 of the rectangular (the length in the depth direction in FIG. 2) is denoted as W2 (depiction is omitted).

Figure 3:
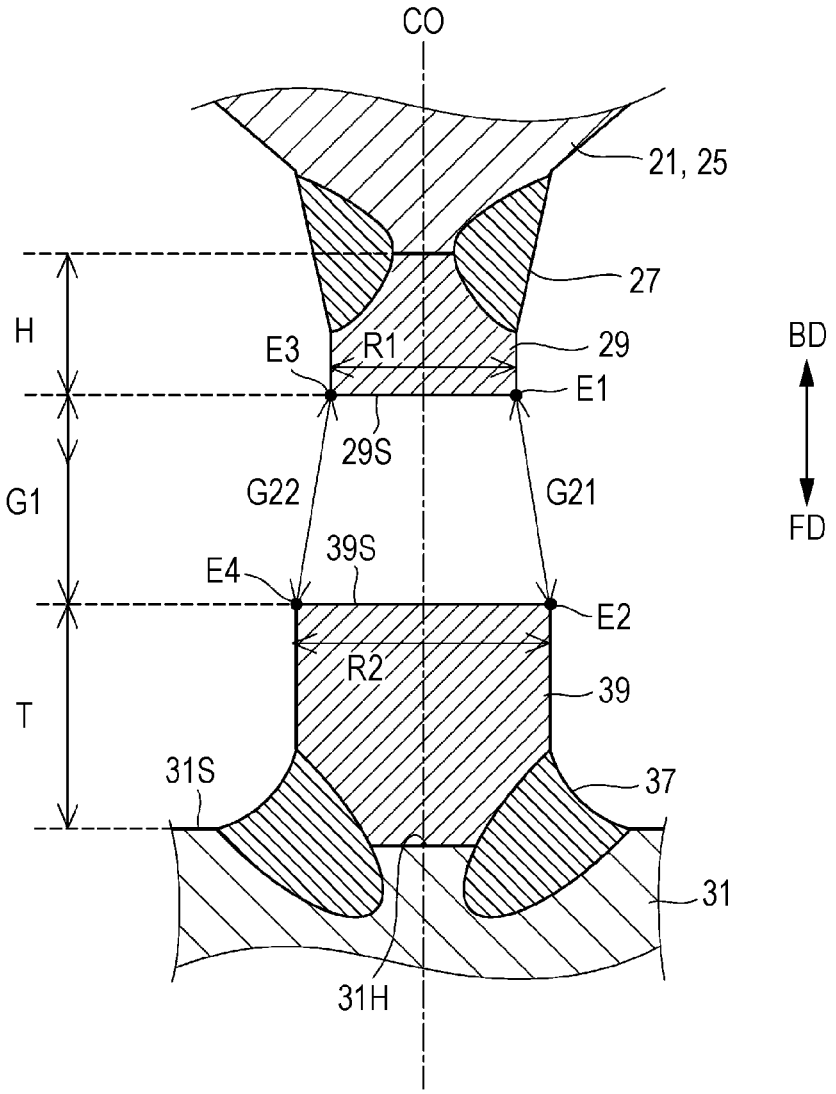
FIG. 3 is an enlarged view around a pair of electrode tips 29 and 39 of the sectional view of FIG. 2.

FIG. 3 is an enlarged view around the electrode tips 29 and 39 of the sectional view of FIG. 2. The center electrode tip 29 is joined to the front end of the center electrode body 21 (the front end of the nose part 25) by, for example, using a laser welding. The portion labeled with number 27 of FIG. 2 is a welded part formed by the laser welding when the center electrode tip 29 is joined. The center electrode tip 29 is formed of the material whose main component is a noble metal of a high melting point. For the material of the center electrode tip 29, for example, Iridium (Ir) or an alloy whose main component is Ir is used and, in the present embodiment, an Ir-11Ru-8Rh-1Ni alloy (an Iridium alloy containing Ruthenium of 11 weight %, Rhodium of 8 weight %, and nickel of 1 weight %) is used.

The ground electrode tip 39 is joined to a face that faces the center electrode 20 side of the surface of the ground electrode body 31 by, for example, using a laser welding. More specifically, the ground electrode tip 39 is resistance-welded to a surface 31S of the ground electrode body 31. The laser welding is then provided and thereby the ground electrode tip 39 is firmly joined to the ground electrode body 31. After the resistance welding is done, the end in the front end direction FD of the ground electrode tip 39 is buried in the ground electrode body 31. Thus, as illustrated in FIG. 3, a contact face 31H of the ground electrode body 31 contacting with the ground electrode tip 39 is located in the front end direction FD side with respect to the surface 31S of the ground electrode body 31. Alternatively, a bottomed, i.e., bored, opening having substantially the same diameter as the ground electrode tip 39 may be formed in the surface 31S of the ground electrode body 31. Then, the laser welding may be provided in a state where the end in the front end direction FD of the ground electrode tip 39 is fitted in the bottomed, i.e., bored, opening. Further, as a result that the ground electrode tip 39 has been joined to the ground electrode body 31 in such the way, the column-shaped ground electrode tip 39 projects toward the center electrode 20 (the center electrode tip 29) from the surface of the ground electrode body 31. The portion labeled with the number 37 in FIG. 2 is a welded part formed by the laser welding in joining the ground electrode tip 39. For the material of the electrode tip 39, for example, Pt (platinum) or an alloy whose main component is Pt is used and, in the present embodiment, a Pt-20Rh alloy (a platinum alloy containing rhodium of 20 weight %) and the like is used.

As described above, the center axis of the center electrode tip 29 and the center axis of the ground electrode tip 39 are matched to the axial line CO in the present embodiment. A front end face 29S of the center electrode tip 29 and a rear end face 39S of the ground electrode tip 39 are opposed to each other in the axial direction and form a gap. In this gap, a spark occurs at the operation of the spark plug 100. These faces 29S and 39S are also referred to as gap forming faces. The distance between the gap forming face 29S of the center electrode tip 29 and the gap forming face 39S of the ground electrode tip 39, that is, the length of the gap (hereafter, also referred to as gap distance) is denoted as G1.

Further, the outer diameter of the gap forming face 29S of the center electrode tip 29 is denoted as R1, and the outer diameter of the gap forming face 39S of the ground electrode tip 39 is denoted as R2. The outer diameter R1 is also referred to as center electrode tip diameter R1 and the outer diameter R2 is also referred to as ground electrode tip diameter R2. In the present embodiment, the ground electrode tip diameter R2 is set larger than the center electrode tip diameter R1 (R1<R2).

The right direction in the sectional view of FIG. 3 is denoted as a first direction and the left direction is denoted as a second direction. The first direction and the second direction are two directions that are orthogonal to the center axis of the center electrode tip 29 (matching the axial line CO in the present embodiment) and directed to the opposite to each other. In the cross section in FIG. 3, the distance between an end E1 in the first direction of the gap forming face 29S of the center electrode tip 29 and an end E2 in the first direction of the gap forming face 39S of the ground electrode tip 39 is denoted as G21. Further, in the cross section in FIG. 3, the distance between an end E3 in the second direction of the gap forming face 29S of the center electrode tip 29 and an end E4 in the second direction of the gap forming face 39S of the ground electrode tip 39 is denoted as G22. The average distance of two distances G21 and G22 is then denoted as G2 (hereafter, also referred to as edge-to-edge distance G2).

In the present embodiment, since the center axis of the center electrode tip 29 matches the center axis of the ground electrode tip 39, the two distances G21 and G22 are equal to each other (G21=G22=G2).

The length from the surface 31S provided with the ground electrode tip 39 of the ground electrode body 31 to the gap forming face 39S of the ground electrode tip 39 is denoted as T (hereafter, also referred to as projection length T).

B: First Evaluation Test

In the first evaluation test, as indicated in Table 1, 20 types of samples A1 to A20 of the spark plug 100 were fabricated and an ignitability test and a wear resistance test were done. The dimensions common to each sample are as follows:

The end part length C: 6.1 mm

The core part length L: 7 mm

The axial direction length H of the center electrode tip 29: 0.5 mm

The projection length T (the axial direction length of the ground electrode tip 39): 0.5 mm The length W1 of the edge of the cross section orthogonal to the center line CL of the ground electrode body 31: 1.4 mm The length W2 of the edge of the cross section orthogonal to the center line CL of the ground electrode body 31: 2.5 mm.

TABLE 1

| Sample number | Center electrode tip diameter R1 | Ground electrode tip diameter R2 | Gap G1 | Edge-to-edge distance G2 | (R2/R1) × (G2/G1) | Ignitability | Wear resistance |
|---|---|---|---|---|---|---|---|
| A1 | 0.55 | 0.7 | 1.1 | 1.1 | 1.28 | Good | Poor |
| A2 | 0.55 | 0.75 | 0.9 | 0.91 | 1.37 | Good | Poor |
| A3 | 0.55 | 0.75 | 1.1 | 1.11 | 1.37 | Good | Poor |
| A4 | 0.55 | 1 | 0.6 | 0.64 | 1.94 | Poor | Good |
| A5 | 0.55 | 1 | 0.8 | 0.83 | 1.89 | Poor | Good |
| A6 | 0.6 | 1 | 0.6 | 0.63 | 1.76 | Good | Good |
| A7 | 0.6 | 0.8 | 0.8 | 0.81 | 1.34 | Good | Poor |
| A8 | 0.6 | 1 | 0.8 | 0.83 | 1.72 | Good | Good |
| A9 | 0.6 | 1 | 1.1 | 1.12 | 1.69 | Good | Excellent |
| A10 | 0.7 | 0.75 | 1.3 | 1.3 | 1.07 | Good | Poor |
| A11 | 0.7 | 0.8 | 0.8 | 0.8 | 1.15 | Good | Poor |
| A12 | 0.7 | 1 | 0.6 | 0.62 | 1.47 | Good | Excellent |
| A13 | 0.7 | 1 | 0.8 | 0.81 | 1.45 | Good | Excellent |
| A14 | 0.7 | 1 | 0.9 | 0.91 | 1.45 | Good | Excellent |
| A15 | 0.7 | 1.2 | 0.8 | 0.84 | 1.8 | Good | Good |
| A16 | 0.8 | 1 | 0.6 | 0.61 | 1.27 | Good | Poor |
| A17 | 0.8 | 1 | 0.8 | 0.81 | 1.26 | Good | Poor |
| A18 | 0.8 | 1.1 | 0.8 | 0.81 | 1.4 | Good | Excellent |
| A19 | 1 | 1.2 | 0.8 | 0.81 | 1.21 | Good | Poor |
| A20 | 1 | 1.2 | 1.1 | 1.11 | 1.21 | Good | Poor |

The 20 types of the samples are different from each other in at least one value of the center electrode tip diameter R1, the ground electrode tip diameter R2, the gap distance G1, and the edge-to-edge distance G2. The center electrode tip diameter R1 is any one of the values of 0.55 mm, 0.6 mm, 0.7 mm, 0.8 mm, and 1.0 mm. The ground electrode tip diameter R2 is any one of the values of 0.7 mm, 0.75 mm, 0.8 mm, 1.0 mm, 1.1 mm, and 1.2 mm so as to be larger value than the center electrode tip diameter R1. As such, the center electrode tip diameter R1 and the ground electrode tip diameter R2 are set to satisfy R1<R2, 0.5 mm≤R1≤1.1 mm, and 0.7 mm≤R2≤1.2 mm.

Further, the gap distance G1 is any one of the values of 0.6 mm, 0.8 mm, 0.9 mm, 1.1 mm, and 1.3 mm. The gap distance G1 is changed by adjusting the axial direction length of the center electrode body 21. As such, the gap distance G1 is set to satisfy 0.6 mm≤G1≤1.3 mm. The edge-to-edge distance G2 is the value determined by the gap distance G1, the center electrode tip diameter R1, and the ground electrode tip diameter R2, and the measurement of the edge-to-edge distance G2 (the average value of the measurements of the distances G21 and G22) is listed in Table 1.

In Table 1, the value of (R2/R1)×(G2/G1) derived by calculation is listed as an index value of the sample.

Figure 4A:
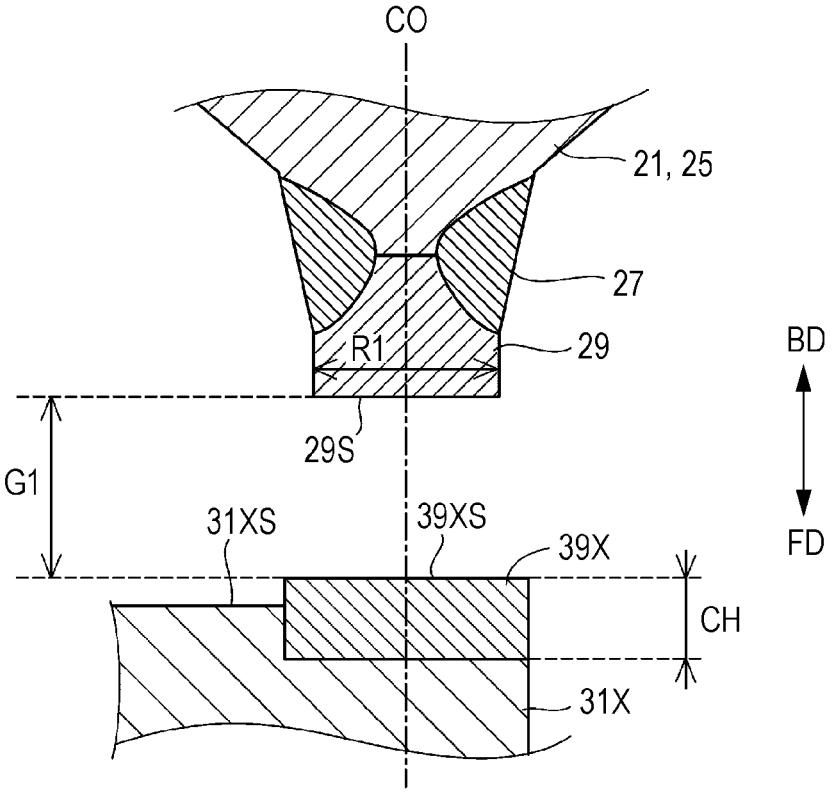
FIG. 4A is a sectional view illustrating a configuration of an end part of a spark plug used in comparison testing.
Figure 4B:
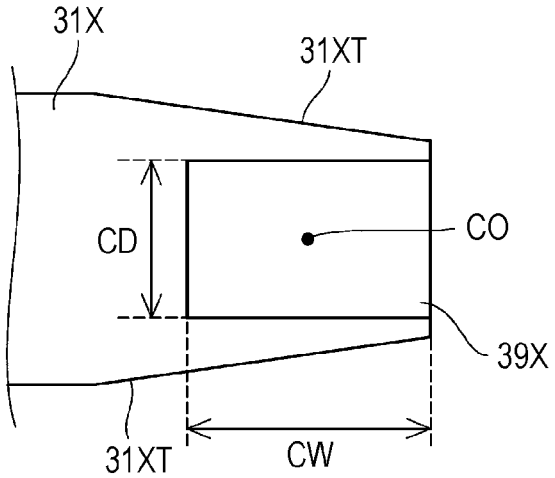
FIG. 4B is a view of the front and part of the ground electrode shown in FIG. 4A, viewed from the rear end direction BD side toward the front end direction FD.

Furthermore, spark plugs of the comparison form were fabricated as the objects to be compared and the same tests as for the samples A1 to A20 of the spark plug 100 were done. FIGS. 4(A) and 4(B) are diagrams showing a configuration of an end part of the spark plug of a comparison form. FIG. 4(A) is a sectional view of a part around the front end part of the ground electrode of a spark plug used in comparison testing. This cross section is a cross section including the center axis of the center electrode tip similarly to FIG. 3. FIG. 4(B) is a view of a part around the front end part of the ground electrode of the spark plug shown in FIG. 4A of the comparison form when viewed from the rear end direction BD side toward the front end direction FD.

In the ground electrode of the spark plug of the comparison form, a plate-like ground electrode tip 39X that is a rectangle in the plan view is used. The ground electrode body 31X of the spark plug of the comparison form has a taper face 31XT formed to have the width decreasing toward the end where the ground electrode tip 39X is arranged (the end in the right direction in FIG. 4). The ground electrode tip 39X is resistance-welded to a surface 31XS in the center electrode side in the ground electrode body 31X. As a result, the ground electrode tip 39X is buried in the ground electrode body 31X to have a state that the gap forming face 39XS of the ground electrode tip 39X projects toward the center electrode by 0.1 mm with respect to the surface 31XS of the ground electrode body 31X. Alternatively, a groove may be formed in the surface 31XS of the ground electrode body 31X, and the ground electrode tip 39X may be resistance-welded to the ground electrode body 31X in a state where the ground electrode tip 39X is fitted in this groove. It is noted that, the sizes of the ground electrode tip 39X are that: the shorter edge length of the rectangle in the plan view CD=0.6 mm the longer edge length CW=0.9 mm, and the thickness CH=0.3 mm.

The configurations other than the ground electrode of the spark plug of the comparison form, for example, the configuration of the center electrode, are the same as those of the spark plug 100 of the embodiment. Therefore, in FIG. 4, the same reference numerals as in FIG. 3 are provided and the description of these configurations will be omitted. It is noted that the spark plugs of the comparison form were fabricated to have the gap distance G1 and the center electrode tip diameter R1 that are the same values as respective samples of the spark plug 100 of the embodiment.

In the ignitability test, respective samples and the spark plugs of the comparison form (hereafter, also referred to as comparison plug(s)) are mounted in the internal combustion engine, respectively, and the Air/Fuel ratio at the ignition limit was examined. Specifically, a gasoline engine featured in a single cylinder, the DOHC (Double OverHead Camshaft), a displacement of 1.5 L, a super-charger, and a high tumble specification was operated at a revolution of 1600 rpm. The internal combustion engine of the high tumble specification is an internal combustion engine in which the flux of the tumble flow generated inside the combustion chamber of the internal combustion engine is enhanced by the improvement of the shape of the intake port. The Air/Fuel ratio of the ignition limit, that is, the maximum ignitable Air/Fuel ratio was then examined by reducing the amount of the fuel supplied to the combustion chamber in one combustion cycle to increase the Air/Fuel ratio stepwise. It is noted that the Air/Fuel ratio was incremented by 0.1. Then, when the Air/Fuel ratio was increased stepwise, the Air/Fuel ratio at which the change rate of the indicated mean effective pressure (IMEP: Indicated Mean Effective Pressure) exceeded 5% was employed as the Air/Fuel ratio at the ignition limit. The indicated mean effective pressure is obtained by dividing a work that a combustion gas applies to a piston for one cycle by a stroke capacity, which is generally used in the evaluation of the combustion state of the engine.

Further, the evaluation of the sample in which the Air/Fuel ratio at the ignition limit was less than or equal to that of the comparison plug was "Poor". That is, the samples with the difference (AF1−AF2) between the Air/Fuel ratio AF1 at the ignition limit of the sample and the Air/Fuel ratio AF2 at the ignition limit of the comparison plug was less than or equal to 0 were evaluated as "Poor". Further, among the samples in which the Air/Fuel ratio at the ignition limit was higher than the comparison plug, the evaluation of the sample in which the difference (AF1−AF2) was greater than or equal to 0.1 and less than or equal to 0.5 was "Good", and the evaluation of the sample in which the difference (AF1−AF2) exceeds 0.5 was "Excellent".

In Table 1, the evaluation result of the ignitability test of each sample is indicated. The evaluation of two types of the samples A4 and A5 in which the index value ((R2/R1)×(G2/G1) of Table 1) exceeds 1.8 was "Poor". The evaluation of 18 types of the samples A1 to A3 and A6 to A20 in which index value is less than or equal to 1.8 was "Good". There was no sample whose evaluation was "Excellent".

The reason for the above is estimated as follows. The smaller the ground electrode tip diameter R2 with respect to the center electrode tip diameter R1 is, the less the expansion of the flame generated at the spark gap (so called expansion of the flame kernel) is likely to be restricted by the ground electrode tip 39. It is therefore considered that the smaller the ground electrode tip diameter R2 with respect to the center electrode tip diameter R1 is (the smaller the R2/R1 is), the more the ignitability of the spark plug is improved. Similarly, the smaller the edge-to-edge distance G2 with respect to the gap distance G1 is, the less the expansion of the frame is likely to be restricted by the ground electrode tip 39. It is therefore considered that the smaller the edge-to-edge distance G2 with respect to the gap distance G1 is (the smaller the G2/G1 is), the more the ignitability of the spark plug is improved. Based on the above, it is considered that the restriction of the expansion of the flame kernel can be suppressed and the ignitability of the spark plug can be improved by setting the center electrode tip diameter R1, the ground electrode tip diameter R2, the gap distance G1, and the edge-to-edge distance G2 so that the index value ((R2/R1)×(G2/G1) of Table 1) is less than or equal to 1.8.

In the wear resistance test, respective samples and the comparison plugs are mounted in the internal combustion engine, respectively, and the increase amount of the gap distance G1 before and after the operation was examined. Specifically, a gasoline engine featured in a serial three-cylinder, the DOHC (Double OverHead Camshaft), a displacement of 0.66 L, a super-charger, and a high tumble specification was operated at a revolution of 6000 rpm for 600 hours. Then, after finishing the operation, the gap distance G1 was measured and the increase amount from the gap distance G1 before the operation was determined.

Further, the evaluation of the sample in which the increase amount of the gap distance G1 was greater than or equal to that of the comparison plug was "Poor". That is, the samples in which the difference (AG1−AG2) between the increase amount AG1 of the gap distance G1 of the sample and the increase amount AG2 of the gap distance G1 of the comparison plug was 0 or greater were evaluated as "Poor". Then, among the samples in which the increase amount from the gap distance G1 was less than that of the comparison plug, the evaluation of the sample in which the difference (AG1−AG2) of the increase amount of the gap distance G1 was greater than or equal to −0.11 and less than 0 was "Good", and the evaluation of the sample in which the difference (AG1−AG2) is less than −0.11 was "Excellent".

In Table 1, the evaluation result of the wear resistance test of each sample is indicated. The evaluation of ten types of the samples A1 to A3, A7, A10, A11, A16, A17, A19, and A20 whose index value ((R2/R1)×(G2/G1) of Table 1) is less than 1.4 was "Poor". The evaluation of ten types of the samples A4 to A6, A8, A9, A12 to A15, and A18 whose index value is greater than or equal to 1.4 was "Good" or "Excellent".

The reason for the above is estimated as follows. A larger ground electrode tip diameter R2 with respect to the center electrode tip diameter R1 results in a larger surface area of the gap forming face 39S of the ground electrode tip 39, so that the increase amount of the gap distance G1 is suppressed and thus the wear resistance is improved. Further, the larger the ground electrode tip diameter R2 with respect to the center electrode tip diameter R1 is, the more the flow of the air-fuel mixture is restricted by the ground electrode tip 39, so that the flux near the spark gap is suppressed. As a result, this allows for the suppression of the phenomenon in which the spark occurs for multiple times at the spark gap (the blow-out of the spark) due to the movement of the spark generated at the spark gap caused by the flux, so that the wear resistance is improved. Similarly, an excessively larger edge-to-edge distance G2 with respect to the gap distance G1 results in a larger surface area of the gap forming face 39S of the ground electrode tip 39, so that the increase amount of the gap distance G1 and the flux near the spark gap are suppressed and thus the wear resistance is improved. Based on the above, it is considered that the wear resistance can be improved by setting the center electrode tip diameter R1, the ground electrode tip diameter R2, the gap distance G1, and the edge-to-edge distance G2 so that the index value ((R2/R1)×(G2/G1) of Table 1) is greater than or equal to 1.4.

As set forth, based on the result of the first evaluation test, in the spark plug that satisfies at least R1<R2, 0.5 mm≤R1≤1.1 mm, 0.7 mm≤R2≤1.2 mm, and 0.6 mm≤G1≤1.3 mm, it was confirmed that it is preferable to satisfy 1.4≤(R2/R1)×(G2/G1)≤1.8. In this way, the optimization of the values of R1, R2, G1, and G2 allows for achieving both the wear resistance and the ignitability of the spark plug 100. Therefore, the ignitability and the wear resistance of the spark plug 100 can be improved.

In further details, among ten types of the samples whose evaluation of the wear resistance was "Good" or "Excellent", that is, among the ten types of the samples whose index value is greater than or equal to 1.4, the evaluation of five types of the samples A9, A12 to A14, and A18 in which the index value is less than or equal to 1.69 was "Excellent". Further, the evaluation of five types of the samples A4 to A6, A8, and A15 whose index value exceeds 1.69 was "Good".

As set forth, based on the result of the first evaluation test, it was confirmed that it is preferable to satisfy (R2/R1)×(G2/G1)≤1.69. In this way, the optimization of the values of R1, R2, G1, and G2 allows for the further improvement of the wear resistance of the spark plug 100.

C: Second Evaluation Test

In the second evaluation test, as indicated in Table 2, five types of sample groups B1 to B5 were fabricated and the ignitability test and the wear resistance test were done similarly to the first evaluation test. Among the five types of the sample groups B1 to B5, the sample of the spark plug that is to be the basis described later is different. Each sample group includes six types of the samples. In the six types of the samples included in one type of the sample group, the above-described projection length T (FIG. 3) is different from each other. The projection lengths T of these six types of the samples are 0.3 mm, 0.5 mm, 0.7 mm, 0.9 mm, 1.1 mm, and 1.3 mm, respectively. In these six types of the samples, the length of the axial direction of the ground electrode tip 39 and the end part length C (FIG. 2) are changed, so that the projection length T only is changed without causing change in the gap distance G1. Among these six types of the samples, the arrangement and dimension except the axial direction length of the ground electrode tip 39 and the end part length C are the same as each other. For example, the sample group B1 is fabricated by changing the length of the projection length T based on the sample A18 of Table 1. Thus, the values of R1, R2, G1, and G2 of the sample group B1 are the same as those of the sample A18 of Table 1. Further, the sample whose projection length T is 0.5 mm in the sample group B1 is completely the same as that of the sample A18 of Table 1. Similarly, the sample groups B2 to B5 are fabricated based on the samples A14, A9, A8, and A15 of Table 1, respectively. Therefore, the values of R1, R2, G1, and G2 of the sample groups B2 to B5 are the same as those of the samples A14, A9, A8, and A15 of Table 1, respectively.

As can be seen from this description, all of the sample groups B1 to B5 satisfy $1.4 \leq (R2/R1) \times (G2/G1) \leq 1.8$. Among them, three sample groups B1 to B3 further satisfy $1.4 \leq (R2/R1) \times (G2/G1) \leq 1.69$.

"Excellent" and the evaluation result of the wear resistance of the one type of the sample whose projection length T exceeds 1.1 mm is "Good".

The reason for the above is estimated as follows. In general, a lower temperature of the ground electrode tip 39 allows for more reduction of the wear amount of the ground electrode tip 39, so that the wear resistance of the spark plug is improved. A smaller projection length T results in a shorter distance between the ground electrode body 31 and the spark gap, so that the heat near the spark gap rising at a high temperature is more likely to be transferred to the ground electrode body 31. As a result, this allows for the improvement of the heat conductivity performance and therefore the suppression of the rise in the temperature of the ground electrode tip 39, so that the wear resistance of the spark plug 100 can be improved. It is thus considered that the projection length T of 1.1 mm or less allows for the improvement of the heat conduction and therefore the improvement of the wear resistance of the spark plug 100.

As set forth, based on the result of the second evaluation test, it was confirmed that it is more preferable to satisfy $1.4 \leq (R2/R1) \times (G2/G1) \leq 1.69$ and $0.7\ \text{mm} \leq T \leq 1.1\ \text{mm}$. In this way, while a larger T tends to result in the improvement of the ignitability but the degeneration of the wear resistance, the optimization of the value of the projection length T further allows for the improvement of the wear resistance and the ignitability of the spark plug.

It is noted that, as indicated in Table 2, in the sample groups B4 and B5 that satisfy $1.4 \leq (R2/R1) \times (G2/G1) \leq 1.8$ but do not satisfy $1.4 \leq (R2/R1) \times (G2/G1) \leq 1.69$, the evaluation result of the wear resistance of the sample whose projection length T is

TABLE 2

| | Sample group | | | | | | | | | |
|---|---|---|---|---|---|---|---|---|---|---|
| | B1 | | B2 | | B3 | | B4 | | B5 | |
| Projection length T | Ignitability | Wear resistance | Ignitability | Wear resistance | Ignitability | Wear resistance | Ignit-ability | Wear resistance | Ignit-ability | Wear resistance |
| 0.3 | Good | Excellent | Good | Excellent | Good | Excellent | Good | Excellent | Good | Excellent |
| 0.5 | Good | Excellent | Good | Excellent | Good | Excellent | Good | Good | Good | Good |
| 0.7 | Excellent | Excellent | Excellent | Excellent | Excellent | Excellent | Excellent | Good | Excellent | Good |
| 0.9 | Excellent | Excellent | Excellent | Excellent | Excellent | Excellent | Excellent | Good | Excellent | Good |
| 1.1 | Excellent | Excellent | Excellent | Excellent | Excellent | Excellent | Excellent | Good | Excellent | Good |
| 1.3 | Excellent | Good | Excellent | Good | Excellent | Good | Excellent | Good | Excellent | Good |

As illustrated in Table 2, in all of the sample groups B1 to B5, the evaluation result of the ignitability of two types of the samples whose projection length T is less than 0.7 mm is "Good", and the evaluation result of the ignitability of four types of the samples whose projection length T is greater than or equal to 0.7 mm is "Excellent".

The reason for the above is estimated as follows. A greater projection length T results in a longer distance between the ground electrode body 31 and the spark gap, so that the expansion of the flame as described above is less likely to be restricted by the ground electrode body 31. It is therefore considered that the greater the projection length T is, the more the ignitability of the spark plug is improved. It is thus considered that the projection length T of 0.7 mm or greater allows for suppressing the restriction of the expansion of the flame kernel and therefore improving the ignitability.

As indicated in Table 2, in all of the three sample groups B1 to B3 satisfying $1.4 \leq (R2/R1) \times (G2/G1) \leq 1.69$, the evaluation result of the wear resistance of the five types of the samples whose projection length T is less than or equal to 1.1 mm is 0.3 mm is "Excellent". Further, the evaluation result of the wear resistance of the five types of the samples whose projection length T is greater than or equal to 0.5 mm is "Good". In this way, in the sample groups B4 and B5, although a tendency that a smaller projection length T allows for the improvement of the wear resistance was recognized, the evaluation of "Excellent" was not obtained within the range of $0.7\ \text{mm} \leq T \leq 1.1\ \text{mm}$.

In this way, it was confirmed that, when $1.4 \leq (R2/R1) \times (G2/G1) \leq 1.69$ is satisfied, the advantageous effect of the improvement of the wear resistance and the ignitability can be more significantly obtained by the optimization of the projection length T than the case where $1.4 \leq (R2/R1) \times (G2/G1) \leq 1.69$ is not satisfied.

D: Third Evaluation Test

In the third evaluation test, as indicated in Table 3, seven types of samples C1 to C7 were fabricated and a pre-ignition test and an anti-peeling performance test were done. The dimensions common to each sample are as follows:

The axial direction length H of the center electrode tip 29: 0.5 mm

The projection length T (the axial direction length of the ground electrode tip 39): 0.5 mm.

The length W1 of the edge of the cross section orthogonal to the center line CL of the ground electrode body 31: 1.4 mm The length W2 of the edge of the cross section orthogonal to the center line CL of the ground electrode body 31: 2.5 mm The center electrode tip diameter R1: 0.7 mm The ground electrode tip diameter R2: 1 mm The gap distance G1: 0.9 mm The edge-to-edge distance G2: 0.91 mm The index value (R2/R1)×(G2/G1): 1.45.

TABLE 3

| Sample number | End part length C | Core part length L | L/C | Pre-ignition | Anti-peeling performance |
|---|---|---|---|---|---|
| C1 | 6.1 | 0 | 0 | Good | Excellent |
| C2 | 8.1 | 4.5 | 0.56 | Good | Excellent |
| C3 | 4.6 | 4.5 | 0.98 | Excellent | Excellent |
| C4 | 8.1 | 9 | 1.11 | Excellent | Excellent |
| C5 | 6.1 | 7 | 1.15 | Excellent | Excellent |
| C6 | 6.1 | 9 | 1.48 | Excellent | Excellent |
| C7 | 4.6 | 9 | 1.96 | Excellent | Good |

As indicated in Table 3, in the seven types of the samples, at least one of the end part length C and the core part length L is different from each other. Specifically, the end part length C is any one of the values of 4.6 mm, 6.1 mm, and 8.1 mm. The core part length L is any one of the values of 0 mm (no core part), 4.5 mm, 7 mm, and 9 mm. It is noted that the end part length C was adjusted by changing the axial direction of the center electrode body 21 and the length along the center line CL (FIG. 2) of the ground electrode body 31. In Table 3, the value of the ratio (L/C) of the length L to the length C is also listed.

In the pre-ignition test, each sample was mounted in the internal combustion engine and the occurrence of the pre-ignition (excessively early ignition) due to the ground electrode 30 was examined. The pre-ignition is a failure that the air-fuel mixture is ignited at an earlier timing than a normal timing. It is considered that the part causing the pre-ignition, that is, the part excessively heated and causing an unintended ignition is the front end part of the insulator 10 and the like besides the ground electrode 30. The pre-ignition due to the ground electrode 30 is a pre-ignition in which the part excessively heated and causing the unintended ignition is the ground electrode 30. In the followings, the pre-ignition due to the ground electrode 30 is simply referred to as pre-ignition.

Specifically, a gasoline engine featured in a serial four-cylinder, the DOHC (Double OverHead Camshaft), a displacement of 1.3 L, no super-charger, and a high tumble specification was operated at full throttle (WOT (Wide-Open Throttle)) and a revolution of 3500 rpm for two minutes. A more advanced ignition timing of the spark plug during the operation results in a greater calorific value that the sample is subjected to, so that the pre-ignition is more likely to occur. In the present evaluation test, in order to make the evaluation under a more severe condition than the specified condition, the ignition timing (the timing of supplying the voltage for the ignition) was advanced by six degrees from the specified ignition timing.

Then, the evaluation of the sample in which no pre-ignition was recognized during the two-minute operation was "Excellent". The evaluation of the sample in which a slight pre-ignition was recognized and no significant pre-ignition was recognized during the two-minute operation was "Good". The evaluation of the sample in which a significant pre-ignition was recognized during the two-minute operation was "Poor".

When the operation of the internal combustion engine stops after the ignition of the spark plug stopped under the state of the pre-ignition occurring, it is determined that the slight pre-ignition is occurring. When the operation of the internal combustion engine continues by the self-ignition despite the fact that the ignition of the spark plug stopped under the state of pre-ignition occurring, it is determined that the significant pre-ignition is occurring.

In Table 3, the evaluation result of the pre-ignition test of each sample is indicated. The evaluation of two types of the samples C1 and C2 whose (L/C) is less than 0.98 was "Good". The evaluation of five types of the samples C3 to C7 whose (L/C) is greater than or equal to 0.98 was "Excellent". There was no sample evaluated as "Poor".

The reason for the above is estimated as follows. A longer core part length L with respect to the end part length C (a greater L/C) allows for the improvement of the heat conductivity performance due to the core part 31D (FIG. 2) having a superior thermal conductivity. As a result, a greater (L/C) allows for the suppression of the excessive heat of the ground electrode 30 (in particular, the front end portion of the ground electrode body 31 and/or the ground electrode tip 39), so that the occurrence of the pre-ignition is suppressed. It is thus considered that the occurrence of the pre-ignition can be suppressed by the (L/C) being set to 0.98 or greater.

In the anti-peeling performance test, each sample was mounted in the internal combustion engine and the occurrence of the crack was examined. Specifically, a gasoline engine featured in a serial four-cylinder, the DOHC (Double OverHead Camshaft), a displacement of 1.3 L, no super-charger, and a high tumble specification was operated for 600 hours. During the operation, the operation at 5000 rpm for one minute and the operation at 750 rpm (idling operation) for one minute are repeated. Thereby, the heating and the cooling are repeated to the spark plug 100.

Then, after the operation, it was checked whether or not a crack has occurred between the ground electrode tip 39 and the welded part 37 of each sample. Specifically, whether or not there is a crack was checked by burying the ground electrode 30 of each sample in a resin and polishing it to expose the cross section illustrated in FIG. 3 and then observing the cross section by a magnifying glass. The evaluation of the sample in which no crack was observed was "Excellent". The evaluation of the sample in which a crack was observed but the removal of the ground electrode tip 39 was not observed was "Good". The evaluation of the sample in which the removal of the ground electrode tip 39 was observed was "Poor".

In Table 3, the evaluation result of the anti-peeling performance test of each sample is indicated. The evaluation of six types of the samples C1 to C6 whose (L/C) is less than or equal to 1.48 was "Excellent". The evaluation of the sample C7 whose (L/C) exceeds 1.48 was "Good". There was no sample evaluated as "Poor".

The reason for the above is estimated as follows. The higher heat conductivity performance is not always the better, rather, there is a case where the high heat conductivity performance is disadvantageous for the anti-peeling performance. That is, the excessively high heat conductivity performance, when the heating and the cooling are repeated to the spark plug 100, causes increased change amount of the temperature near the ground electrode tip 39. As a result, in the thermal expansion and the thermal contraction of the members due to the heating and the cooling, the excessively high heat conductivity performance causes an increased expansion amount and contraction amount of the ground electrode tip 39, the welded part 37, and/or the front end part 31B of the ground electrode body 31. As a result, the difference in the thermal expansion coefficient between the welded part 37 and the ground electrode tip 39 causes the stress occurring between the welded part 37 and the ground electrode tip 39 to increase. Further, the excessively high heat conductivity performance causes an increased concentration gradient between the welded part 37 near the ground electrode body 31 and the ground electrode tip 39 far from the ground electrode body 31. This also causes the stress occurring between the welded part 37 and the ground electrode tip 39 to increase. Therefore, the crack is more likely to occur between the welded part 37 and the ground electrode tip 39, so that the anti-peeling performance is degenerated. Therefore, with the (L/C) being set to 1.48 or less, the excessively increased heat conductivity performance can be suppressed and the anti-peeling performance can be improved.

As set forth, based on the result of the third evaluation test, it was confirmed that it is more preferable to satisfy $0.98 \leq (L/C) \leq 1.48$. In this way, although a higher heat conductivity performance tends to result in the suppression of the occurrence of the pre-ignition but the degeneration of the anti-peeling performance, the optimization of the (L/C) allows for achieving both the suppression of the occurrence of the pre-ignition and the improvement of the anti-peeling performance.

D: Modified Examples:

In the above-described embodiment, the center axis of the ground electrode tip 39 completely matches the center axis of the center electrode tip 29. Alternatively, the center axis of the ground electrode tip 39 may not match the center axis of the center electrode tip 29 accidentally due to the manufacturing error or on purpose for some reason in the design. Even when the center axis of the ground electrode tip 39 matches or does not match the center axis of the center electrode tip 29, any particular cross section including the center axis of the center electrode tip 29 can be used for the cross section for determining R1, R2, G1, and G2.

Further, when the center axis of the ground electrode tip 39 does not match the center axis of the center electrode tip 29, the edge-to-edge distance G21 in the first direction of FIG. 3 may be different from the edge-to-edge distance G22 in the second direction. In this case, the average distance of the two distances G21 and G22 can be used as the edge-to-edge distance G2, as described in the above-described embodiment.

(2) In the above-described embodiment, the ground electrode tip 39 is welded directly on the surface 31S of the ground electrode body 31. Alternatively, a stage projecting from the surface 31S of the ground electrode body 31 toward the center electrode 20 may be arranged and the ground electrode tip 39 may be welded on this stage. That is, in FIG. 2, the stage may be arranged between the ground electrode tip 39 and the ground electrode body 31. In this case, a sum value of the axial direction length of the stage and the axial direction length of the ground electrode tip 39 is used for the projection length T. As can be seen from the above description, the ground electrode tip 39 is an example of the projection part in the above-described embodiment, and the entirety of the stage and the ground electrode tip 39 is an example of the projection part in the present modified example.

(3) It is considered that the improvement of the ignitability and the wear resistance of the spark plug 100 of the above-described embodiment are achieved by that R1, R2, G1, and G2 are set within the above-described ranges, as described above. Therefore, elements other than these parameters, for example, the material and/or the dimension of the details of the metal shell 50, the material and/or the dimension of the details of the insulator 10, and the like may be changed in various ways. For example, the material of the metal shell 50 may be a low-carbon steel plated with a zinc plating or a nickel plating, or may be a non-plated low-carbon steel. Further, the material of the insulator 10 may be various insulating ceramics other than alumina. Further, the ground electrode body 31 may not have the core part 31D.

(4) Although the core part 31D buried in the ground electrode body 31 of the spark plug 100 in the above-described embodiment is formed of one layer, the core part 31D may be formed by multiple layers. For example, the core part 31D may have a two-layer structure having an external layer that is formed of copper and an internal layer that is buried inside the external layer and formed of nickel.

As set forth, while the present invention has been described based on the embodiments and the modified examples, the above-described forms of implementing the invention are intended to facilitate the understanding of the present invention and not intended to limit the present invention. The present invention can be modified and/or improved without departing from the spirit thereof and the scope of the claims, and its equivalents are included in the present invention.

DESCRIPTION OF REFERENCE NUMERALS

5 Gasket
6 Ring member
8 Plate packing
9 Talc
10 Insulator
12 Through hole
13 Nose part
15 Step part
16 Step part
17 Front-end-side trunk part
18 Rear-end-side trunk part
19 Flange part
20 Center electrode
21 Center electrode body
21A Electrode base material
21B Core part
23 Head part
24 Flange part
25 Nose part
29 Center electrode tip
29 Electrode tip
30 Ground electrode
31 Ground electrode body
33 Electrode tip
37 Welded part
39 Ground electrode tip
40 Terminal metal fitting
41 Cap mounting part
42 Flange part
43 Nose part
50 Metal shell
51 Tool engagement part
52 Mounting screw part
53 Crimp part
54 Seat part
56 Step part
58 Compressively deformed part
59 Insertion hole
60 Conductive seal

70 Resistor
80 Conductive seal
100 Spark plug

Having described the invention, the following is claimed:

1. A spark plug comprising:

a center electrode including a center electrode body extending in an axial direction and a center electrode tip joined to a front end of the center electrode body;

an insulator having an axial hole extending in the axial direction, the center electrode being arranged in the axial hole;

a metal shell arranged around an outer circumference of the insulator; and a ground electrode including a ground electrode body electrically connected to the metal shell and a projection part that is a portion projecting toward the center electrode from an end part of the ground electrode body, the projection part including a ground electrode tip forming a gap between itself and the center electrode tip, wherein a particular cross section includes a center axis of the center electrode tip, wherein two directions that are orthogonal to the center axis of the center electrode tip and opposed to each other are denoted as a first direction and a second direction, wherein an outer diameter of a first face that is a face of the center electrode tip forming the gap is denoted as R1, wherein an outer diameter of a second face that is a face of the ground electrode tip forming the gap is denoted as R2, wherein a length of the gap is denoted as G1, wherein an average distance of a distance between an end in the first direction of the first face and an end in the first direction of the second face and a distance between an end in the second direction of the first face and an end in the second direction of the second face is denoted as G2, and wherein the following is satisfied:

$$R2/R1>1,$$

$$R1<R2,$$

$$G2/G1>1,$$

$$0.5\ \text{mm}\leq R1\leq 1.1\ \text{mm},$$

$$0.7\ \text{mm}\leq R2\leq 1.2\ \text{mm},$$

$$1<R2/R1<1.8,$$

$$0.6\ \text{mm}\leq G1\leq 1.3\ \text{mm, and}$$

$$1.4\leq R2/R1\times G2/G1\leq 1.8.$$

2. The spark plug according to claim 1, wherein R2/R1×G2/G1≤1.69 is satisfied.

3. The spark plug according to claim 2, wherein, when a length to the second face from a surface of the ground electrode body on which the projection part is arranged is denoted as T, 0.7 mm≤T≤1.1 mm is satisfied.

4. The spark plug according to any one of claims 1 to 3, wherein the ground electrode body is a bar-shaped member including a base material that is a portion forming at least a part of a surface of the ground electrode body and a core part buried in the base material and having a higher thermal conductivity than the base material, and wherein, when a length in a longitudinal direction of a portion including the core part of the ground electrode body along a shape of the ground electrode body is denoted as L and a length in the axial direction from a front end of the metal shell to a front end of the ground electrode is denoted as C, 0.98≤L/C≤1.48 is satisfied.

* * * * *